US007409767B2

(12) United States Patent
Dombrowski et al.

(10) Patent No.: US 7,409,767 B2
(45) Date of Patent: Aug. 12, 2008

(54) RAZOR HANDLE

(75) Inventors: David Dombrowski, Madison, CT (US); Armin Bartschi, Triengen (CH)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 11/399,025

(22) Filed: Apr. 5, 2006

(65) Prior Publication Data

US 2006/0260142 A1 Nov. 23, 2006

Related U.S. Application Data

(60) Provisional application No. 60/668,759, filed on Apr. 5, 2005.

(51) Int. Cl.
*B26B 19/28* (2006.01)
*B26B 19/12* (2006.01)
*B26B 19/38* (2006.01)

(52) U.S. Cl. ..... 30/340; 30/42; 30/44; 30/45

(58) Field of Classification Search ..... 30/44, 30/45, 46, 50, 77, 83, 42, 47, 340
See application file for complete search history.

(56) References Cited

U.S. PATENT DOCUMENTS 5,299,354 A 4/1994 Metcalf et al.
5,582,476 A * 12/1996 Hansen ..... 362/115
2005/0034307 A1 2/2005 Brzezinski

OTHER PUBLICATIONS

International Search Report dated Aug. 3, 2006.

* cited by examiner

*Primary Examiner*—Timothy V Eley
(74) *Attorney, Agent, or Firm*—Michaud-Duffy Group LLP

(57) ABSTRACT

According to one aspect of the present invention, a razor handle includes a first handle and a removable cap. The first handle portion includes a first molded portion, a second molded portion, and a cavity. A removable cap includes a first molded cap portion and a second molded cap portion. The second molded cap portion forms a sealing ring on the removable cap. The removable cap is selectively detachable to the first handle portion. The sealing ring, when the removable cap is attached to the first handle portion, forms a seal between the removable cap and the first handle portion, preventing water from entering the cavity during normal shaving. Preferably, the first molded cap portion and the first molded portion of the first handle portion are formed simultaneously. Likewise, the second molded cap portion and the second molded portion of the first handle portion are preferably formed simultaneously.

10 Claims, 3 Drawing Sheets

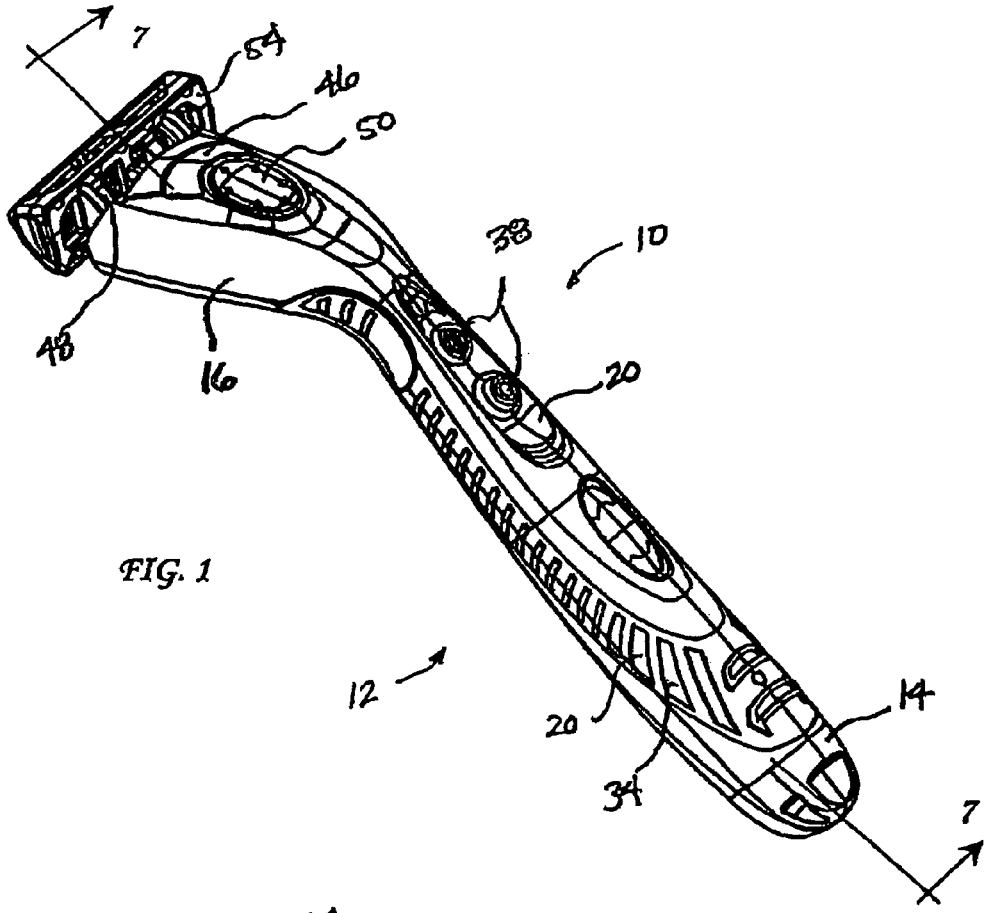
FIG. 1
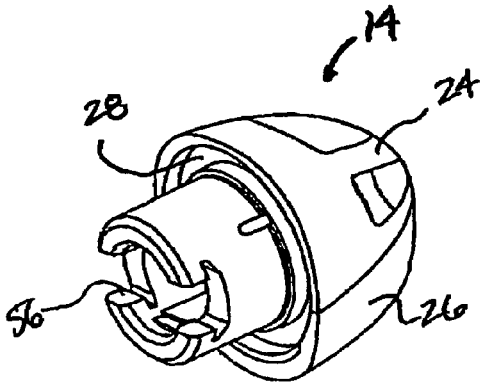
FIG. 2
FIG. 3
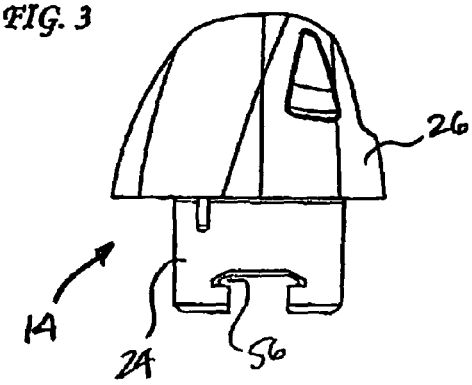

RAZOR HANDLE

CROSS REFERENCE TO RELATED APPLICATIONS

This application is entitled to the benefit of and incorporates by reference the disclosure of U.S. patent application Ser. No. 60/668,759 filed on Apr. 5, 2005, entitled "Razor Handle and Method for Making Same."

BACKGROUND OF THE INVENTION

1. Field of the Invention

The present invention relates generally to handles for shaving implements, and, more particularly, to a process for manufacturing two-shot molded cap for a handle that prevents water from entering a cavity in the handle during normal use.

2. Description of the Prior Art

Modern shaving implements can include a plurality of blades disposed within a razor cartridge. The razor cartridge is, in turn, mounted on a handle during use. Some safety razors have a disposable razor cartridge that is removably mounted on a reusable handle while others have a handle and a razor cartridge that are manufactured as a single, disposable unit.

It also is known to place certain powered devices, such as a spinning eccentric weight that cause the shaving implement to vibrate, inside the handle. The powered devices typically provide some additional benefit to the end user. In most cases, the powered device requires the use of a replaceable (or rechargeable) battery.

Razors that employ a replaceable battery typically have a handle that includes a cavity into which a battery can be inserted, and a removable cap. Typically, the removable cap, when secured to the remaining portion of the handle, forms a seal around the cavity. The seal prevents water from entering the cavity, which can adversely affect the intended function of the battery and associated electronics. Currently, it is known to use, for example, an o-ring that is compressed between the removable cap and the remaining portion of the cartridge. However, the manufacture of an o-ring, and its placement on the handle during assembly is both costly and time-consuming.

It is, therefore, an object of the present invention to overcome the known shortcomings of the prior art.

SUMMARY OF THE DISCLOSURE

According to one aspect of the present invention, a razor handle includes a first handle and a removable cap. The first handle portion includes a first molded portion, a second molded portion, and a cavity. The cavity is defined by at least partially the first molded portion. A removable cap includes a first molded cap portion and a second molded cap portion. The second molded cap portion forms a sealing ring on the removable cap. The removable cap is selectively detachable to the first handle portion. The sealing ring, when the removable cap is attached to the first handle portion, forms a seal between the removable cap and the first handle portion, preventing water from entering the cavity during normal shaving.

According to another aspect of the present invention, a method for making a handle (e.g., as described above) is disclosed. The steps for making the handle include injection molding a first molded portion of a first handle portion and a first molded cap portion of a removable cap simultaneously, placing the battery-powered device on the first molded portion of the first handle portion, and injection molding a second molded portion of the first handle portion and a second molded cap portion of the removable cap simultaneously.

The first molded portion of the first handle portion forms at least a portion of the cavity, which is configured for housing a battery. The second molded portion of the first handle portion at least partially encases the battery-powered device in the first handle portion. The second molded cap portion of the removable cap forms a sealing ring. The sealing ring, when the removable cap is attached to the first handle portion, forms a seal between the removable cap and the first handle portion, preventing water from entering the cavity during normal shaving.

One advantage of the present invention is that a sealing ring can be formed during the same molding process that the electronic device is at least partially captured within the first handle portion. Time and money can be saved by reducing the number of steps required to form the first handle portion and the removable cap.

The above advantage, and other advantages, of the present invention will be apparent to one of skill in the art in light of the Detailed Description and Drawings.

BRIEF DESCRIPTION OF THE DRAWINGS

FIG. 1 is a perspective view of one embodiment of the present invention with a razor cartridge mounted thereon;

FIG. 2 is a perspective view of the removable cap shown in FIG. 1;

FIG. 3 is a side view of the removable cap shown in FIG. 1;

DETAILED DESCRIPTION

Figure 4:
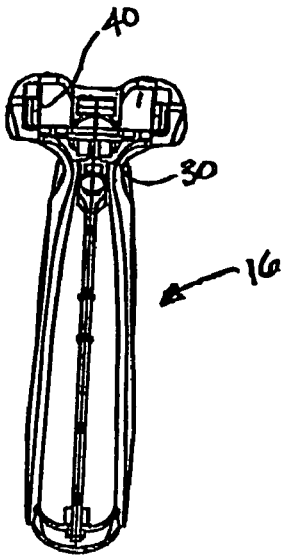
FIG. 4 is a front view of the first shot mold of the first handle portion shown in FIG. 1.

Referring to FIGS. 1-3, a razor handle 10 includes a first handle portion 12, and a removable cap 14. The first handle portion 12 includes a first molded portion 16, a battery-powered device 18 (see FIG. 7), a second molded portion 20, and a cavity 22 (see FIG. 6). The removable cap 14 includes a first molded cap portion 24 and a second molded cap portion 26. The second molded cap portion 26 forms a sealing ring 28.

Figure 5:
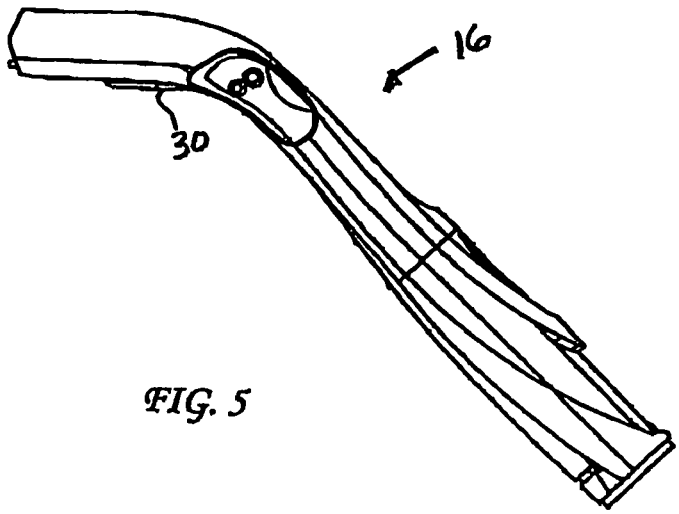
FIG. 5 is a side view of the first shot mold of the first handle portion shown in FIG. 1.
Figure 6:
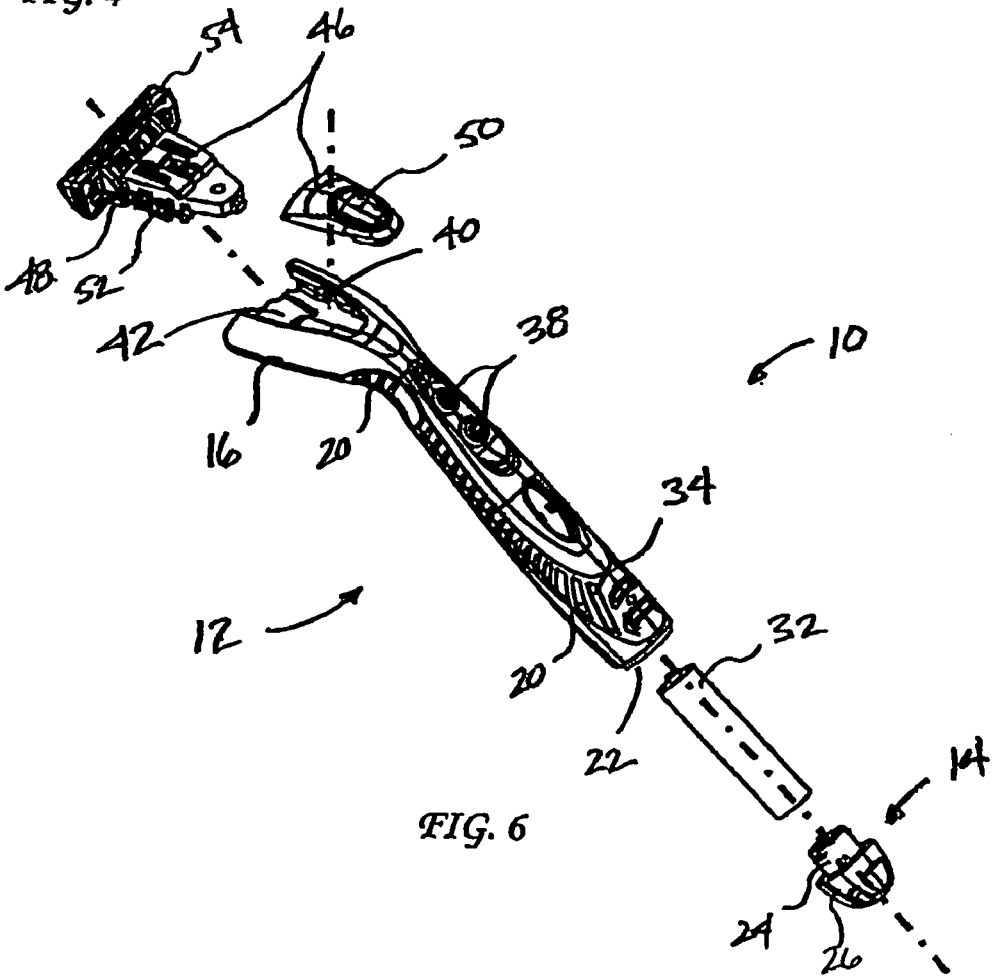
FIG. 6 is an exploded perspective view of the shaving implement of FIG. 1.

Referring now to FIGS. 4-6, the first handle portion 12, as mentioned above, includes the first molded portion 16, the battery-powered device 18 (see FIG. 7), the second molded portion 20, and the cavity 22. The first molded portion 12 can be formed of a rigid molded material that provides the razor handle 10 with the necessary mechanical strength. For example, the first molded portion 16 may be made of Glass Fiber Polypropylene ("GFPP") sold commercially by the Goodrich Company, (wholly owned by P. N. Ray Co. Ltd of Shatin N. T., Hong Kong). GFPP has proven to have desirable density (1.00 g/cm$^3$), tensile strength (87 MPa), and flexural strength (108 MPa), as well as an appropriate hardness (Rockwell Hardness R-scale 111). Accordingly, GFPP is capable of supplying a desirable balance of mechanical properties for the razor handle 10, such as weight, structural stability, and an attractive finish. GFPP is also flexible enough to provide battery-powered device connecting member 30.

However, the first molded portion of the present invention should not be considered to be constrained to the above example material, as any number of molded materials can be used.

Figure 7:
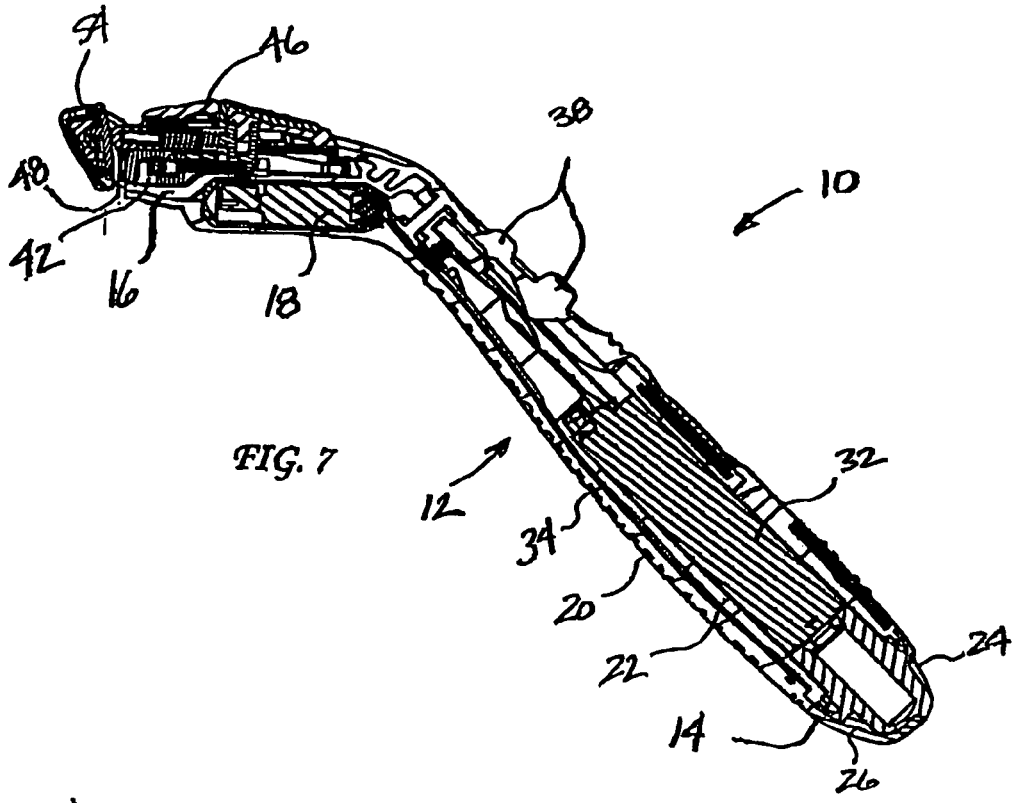
FIG. 7 is a sectional view of the shaving implement of FIG. 1 along line 7-7.

Referring to FIGS. 4 and 5, the first handle portion 12 can include one or more battery-powered device connecting members 30. The battery-powered device connecting member 30 is operable to receive and secure in place the battery-powered device 18 associated with the first handle portion 12 during a subsequent molding operation. As shown in FIG. 7, the battery-powered device connecting member 30 can be at least two projections that engage the battery-powered device 18, snapping the device 18 in place. However, the battery-powered device connecting member 30 may be comprised of any structure suitable for receiving and securing the battery-powered device to the first molded portion known to one of skill in the art.

The battery-powered device 18 can be any device that either that provides some benefit to the end user. For example, in a preferred embodiment, the battery-powered device 18 is a motor that spins an eccentric weight, as shown in FIG. 7. In some embodiments, the battery-powered device 18 further includes wiring, switch (es), sensor(s), and/or other additional electronic components. The battery-powered device 18 is, as shown in FIG. 6, connected to a battery 32 housed in the cavity 22 during normal use.

Referring now to FIGS. 1 and 7, the second molded portion 20 of the first handle portion 12 is applied onto the first molded portion 16, and at least partially encases the battery-powered device 18. Preferably, especially in embodiments utilizing a motor that spins an eccentric weight, the battery-powered device 18 is completely encased within the second molded portion 20 and the first molded portion 16. Completely encasing the battery-powered device 18 can protect the battery-powered device 18 from coming into contact with water and other substances that may affect the intended operation of the device 18.

In some embodiments, the second molded portion 20 can be formed of thermoplastic rubber ("TPE"), and preferably VYRAM® rubber 9211-35W906 that is commercially available through Advanced Elastomer Systems (AES) of Akron, Ohio, USA. The TPE material identified above has desirable hardness (45 Shore A), specific gravity (0.92), (ultimate) tensile strength (3.0 MPa), (ultimate) elongation (450%). The TPE material also has desirable compressive qualities, which are useful for creating gripping structures 34, and a sealing ring 28.

The second molded portion 20 may also be utilized to form additional features on the first handle portion 12. For example, the second molded portion 20 may form at least a portion of the cavity 22, gripping structures 34 (see e.g., FIG. 1), switches 38 for the battery-powered device 18 (see e.g., FIG. 1), and/or pod connecting members 40. Furthermore, the second molded portion 20 may be a single, unitary piece, or can include several separate elements, as shown in FIG. 1.

The first handle portion 12 forms a cavity 22 sized for receiving at least a portion of a battery 32. The cavity 22 may be formed of the first molded portion 16 and/or the second molded portion 20. Using the materials listed above, it is preferable that the cavity 22 be formed primarily of the first molded portion 16 because of its rigidity and hardness. The GFPP material can provide for a stable cavity 22 that is less likely to undesirably change shape during the life of the first handle portion 12. In some embodiments, the cavity 22 is sized for receiving at least a portion of a standard, AAA-sized battery 32, as shown in FIG. 7. However, the cavity 22 may also be sized to receive at least a portion of any sized battery 32. Preferably, the cavity 22 is oriented within the razor handle 10 such that the first handle portion 12 remains ergonomically shaped.

The first handle portion 12 can also include a cap-connecting member. The cap-connecting member is operable to releasably connect the removable cap 14 to the first handle portion 12 such that the removable cap 14 encloses the cavity 22.

In some embodiments, and now referring now to FIG. 6, the first handle portion 12 may also include an auxiliary cavity 42. The auxiliary cavity 42 can include a pod-connecting member 40, and is sized and shaped to receive a connecting pod 46. The connecting pod 46 is typically pre-assembled, and includes a cartridge-connecting member 48, a release mechanism 50, and a handle-connecting member 52. The handle-connecting member 52 of the connecting pod 46, and the pod-connecting member 40 of the first handle portion 12 cooperate to connect the connecting pod 46 and the first handle portion 12. Typically, once connected, the connecting pod 46 and the first handle portion 12 are not intended to be separated during normal use. The first handle portion 12 may include cartridge-connecting members for removably connecting the first handle portion 12 directly to a replaceable razor cartridge 54.

Referring now to FIGS. 1-3 and 8, the removable cap 14 includes a first molded cap portion 24 and a second molded cap portion 26. The second molded cap portion 26 includes the sealing ring 28, and the removable cap 14 also includes a handle connecting member 56. The first and second molded cap portions 24, 26, together, form a removable cap 14 that is sized and shaped to be selectively detachable from the first handle portion 12, and that can enclose the cavity 22 of the first handle portion 12. The removable cap 14 may have any shape, such as the one shown in FIGS. 2 and 3, but preferably the removable cap is curved and free from sharp edges.

Figure 8:
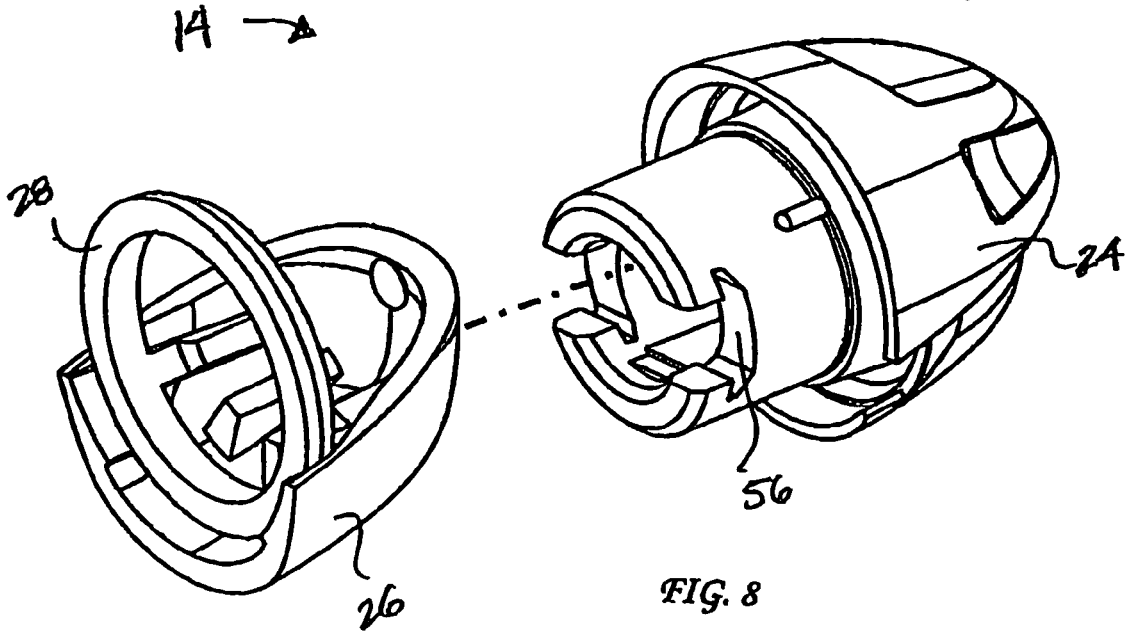
FIG. 8 is an exploded view of the removable cap of FIG. 2.

The first molded cap portion 24, shown in FIG. 8, is preferably comprised of the same material as the first molded portion 16 of the first handle portion 12. Accordingly, both portions 16, 24 can be formed at the same time, in the same molding process. In embodiments using the GFPP material disclosed above, the first molded cap portion 24 preferably forms at least a portion of the removable cap 14 that is adjacent the cavity 22 when the removable cap 14 is attached to the first handle portion 12. The rigidity of the GFPP material advantageously provides a consistent shape and structural integrity to the cavity 22 during normal use.

The second molded cap portion 26, also shown in FIG. 8, is preferably comprised of the same material as the second molded portion 20 of the first handle portion 12. Accordingly, both portions 20, 26 can be formed at the same time, in the same molding process. The second molded cap portion 26 further includes the sealing ring 28, as shown in FIGS. 3 and 8, which forms a seal between the first handle portion 12 and the removable cap 14 when the two are attached.

The removable cap 14 further includes a handle connecting member 56 that cooperates with the cap connecting member of the first handle portion 12. The handle connecting member 56 is complimentary with the sealing ring 28 and, when attached, compresses the sealing ring in a sufficient manner to prevent water from entering the cavity during normal use.

One method for making the razor handle 10 of the present invention includes the following steps. The first molded portion 16 of the first handle portion 12 and the first molded cap portion 24 of a removable cap 14 are injection molded simultaneously. The battery-powered device 18 is then secured on the first molded portion of the first handle by the battery-powered device connecting member(s) 30. The second molded portion 20 of the first handle portion 12 and the second molded cap portion 26 of the removable cap 14 are then injection molded simultaneously. During the latter injection molding process, the second molded portion 20 of the first handle portion 12 at least partially encases the battery-powered device 18 in the first handle portion 12, and the sealing ring 28 on the replaceable cap 14 is formed.

In some embodiments the first handle portion 12 and/or the removable cap 14, may include additional molded portion(s) and/or an additional molded cap portion(s), respectively. The additional portion(s) may be formed at any point in time during before, during or after the two (2) injection molding processes described in the preceding paragraph.

In assembly, and referring to FIGS. 1, 6 and 7, a battery 32 is placed in the cavity 22 and the replaceable cap 14 is attached to the first handle portion 12 by connecting cap connecting member of the first handle portion 12 to the handle connecting member 56 of the replaceable cap. During the attachment, the sealing ring 28 is compressed in a sufficient manner to prevent water from entering the cavity 22 during normal use. In some embodiments, a connecting pod 46 may also be attached to the auxiliary cavity 42 of the first handle portion 12 by attaching the pod connecting member(s) 40 of the first handle portion 12 and the handle connecting member (s) 52 of the connecting pod 46.

In use, in embodiments where the battery-powered device 18 is a motorized spinning eccentric weight, the user selectively turns on the battery powered device 18, causing the razor handle 10 to vibrate, and shaves hair from the desired surface. Once the stored energy in the battery 32 has expired, the user may selectively remove the removable cap 14, replace (or recharge) the battery 32, and re-attach the removable cap 14 to the first handle portion 12 for continued use.

Modification and variations may be made to the disclosed embodiments without departing from the subject and spirit of the invention as defined by the following claims.

What is claimed is:

1. A razor handle, comprising:

a first handle portion including a first molded portion, a second molded portion that is formed on at least a portion of the first molded portion, and a cavity for holding a battery, the cavity being defined at least partially by the first molded portion;

a battery-operated device that is at least partially between the first and second molded portions of the first handle portion; and a removable cap including a first molded cap portion and a second molded cap portion that is formed on the first molded cap portion, the second molded cap portion forming a sealing ring on the removable cap, the removable cap being selectively detachable to the first handle portion;

wherein the sealing ring forms a seal between the removable cap and the first handle portion, preventing water from entering the cavity during normal shaving;

wherein the first handle portion includes one or more battery-powered device connecting members operable to receive and secure the battery-powered device associated with the first handle portion during subsequent molding operation(s); and wherein the one or more battery powered device connecting members comprises two or more projections for engaging the battery powered device.

2. The razor handle of claim 1, wherein the first molded portion and the first molded cap portion are formed in the same molding process.

3. The razor handle of claim 2, wherein the second molded portion and the second molded cap portion are formed in the same molding process.

4. The razor handle of claim 1, wherein the second molded portion and the second molded cap portion are formed in the same molding process.

5. The razor handle of claim 1, the first molded portion being formed from a rigid molded material.

6. The razor handle of claim 1, wherein the battery-powered device is a motor which spins an eccentric weight.

7. The razor handle of claim 1, wherein the second molded portion of the first handle portion is applied onto the first molded portion and at least partially encases the battery-powered device.

8. The razor handle of claim 1, wherein the battery-powered device is completely encases within the first and second molded portions.

9. The razor handle of claim 1, the second molded portion being formed of a thermoplastic material.

10. The razor handle of claim 1, wherein the first handle portion includes an auxiliary cavity and a pod-connecting member, the pod-connecting member being sized and shaped to receive a connecting pod and operable to connect the connecting pod and the first handle portion, the connecting pod further including a cartridge-connecting member, a release mechanism and a handle-connecting member.

* * * * *